US006975268B2

(12) United States Patent
Coleman et al.

(10) Patent No.: US 6,975,268 B2
(45) Date of Patent: Dec. 13, 2005

(54) PHASED ARRAY ANTENNA INCLUDING A DISTRIBUTED PHASE CALIBRATOR AND ASSOCIATED METHOD

(75) Inventors: John Roger Coleman, Palm Bay, FL (US); Travis Sean Mashburn, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 157 days.

(21) Appl. No.: 10/787,963

(22) Filed: Feb. 26, 2004

(65) Prior Publication Data

US 2005/0190104 A1 Sep. 1, 2005

(51) Int. Cl.[7] ..... H01Q 3/22
(52) U.S. Cl. ..... 342/375; 342/368
(58) Field of Search ..... 342/375

(56) References Cited

U.S. PATENT DOCUMENTS 5,943,010 A 8/1999 Rudish et al. ..... 342/372
6,861,975 B1 * 3/2005 Coleman, Jr. et al. ..... 342/174
2004/0243326 A1 * 12/2004 Daoud et al. ..... 702/65

OTHER PUBLICATIONS

Brauner, T. et al, "A Versatile Calibration Method for Small Active Antenna Arrays," 33rd European Microwave Conf, Munich 2003, pp. 797-800.*

* cited by examiner

*Primary Examiner*—Gregory C. Issing
(74) *Attorney, Agent, or Firm*—Allen, Dyer, Doppelt, Milbrath & Gilchrist, P.A.

(57) ABSTRACT

A phased array antenna includes a transmission line network, e.g. optical or coaxial cable network, and a reference signal generator to provide a reference frequency signal to each of the antenna radiating elements. A phase calibrator generates a calibration signal. e.g. a swept frequency signal, on the transmission line network which is also reflected to create a reflected calibration signal. The phase calibrator determines a frequency difference between the calibration signal and the reflected calibration signal at each of a plurality of taps, and outputs a delay measurement signal to the antenna radiating elements, e.g. via an antenna controller, for adjusting a phase of the reference frequency signal.

30 Claims, 2 Drawing Sheets

PHASED ARRAY ANTENNA INCLUDING A DISTRIBUTED PHASE CALIBRATOR AND ASSOCIATED METHOD

FIELD OF THE INVENTION

The present invention relates to the field of communication networks, and is particularly directed to phased array antennas for synthetic aperture radar (SAR) and the like.

BACKGROUND OF THE INVENTION

Phased array antennas are commonly used in satellite, electronic warfare, radar and communication networks. A phased array antenna includes a plurality of antenna elements and respective phase shifters that can be adjusted for producing a focused antenna beam steerable in a desired direction. A scanning phased array antenna steers or scans the direction of the RF signal being transmitted therefrom without physically moving the antenna. Likewise, the scanning phased array antenna can be steered or scanned without physically moving the antenna so that the main beam of the phased array antenna is in the desired direction for receiving an RF signal. This enables directed communications in which the RF signal is electronically focused in the desired direction.

Regardless of the chosen array geometry, it is required that the signal along each path between a signal source and the antenna elements have a controlled phase and magnitude to form a desired antenna pattern. This is achieved by controlling signal power division ratios and the phase shift in the electrical transmission path between the signal source and each antenna element. A structure which performs this function is generally referred to as an antenna feed.

In a conventional series feed network, a series of antenna elements are connected in a single transmission line with a built in phase progression between the antenna elements. The phase progression is determined in part by the length of the transmission line (physical path length) between successive antenna elements. The phase of the signal at each element is related to the electrical path length between antenna elements. The electrical path length, expressed in wavelengths, changes with frequency for a fixed physical path length. Therefore, the phase progression between antenna elements in a series feed varies with frequency.

Conventional methods of open loop calibration suffer from an inability to accurately model temperature gradient. Degradation of phase control causes defocusing of the antenna beam. Such conventional methods include making measurements on ground and loading information into a table. However, earth conditions are not the same as conditions at the antenna station. Also, sunlight obscuration and other conditions limit the accuracy of such an approach. Another method involves calibrating the phase using a known target. However, again, the sun angle changes and obscuration limit time that accuracy of the measurement is valid.

SUMMARY OF THE INVENTION

In view of the foregoing background, it is therefore an object of the present invention to provide a more accurate calibration of phase in a phased array antenna.

This and other objects, features, and advantages in accordance with the present invention are provided by a phased array antenna including a plurality of antenna radiating elements, a transmission line network, e.g. optical or coaxial cable network, connected to the plurality of antenna radiating elements and including a plurality of taps, and a reference signal generator connected to the transmission line network to provide a reference frequency signal to each of the plurality of antenna radiating elements. A phase calibrator generates a calibration signal, e.g. a swept frequency signal, on the transmission line network, the swept frequency signal being reflected at the reference signal generator to create a reflected swept frequency signal. The phase calibrator determines a frequency difference between the swept frequency signal and the reflected swept frequency signal at each of the plurality of taps, and outputs a delay signal to the antenna radiating elements, e.g. via an antenna controller, for adjusting a phase of the reference frequency signal.

The phase calibrator preferably comprises a direct digital synthesizer (DDS) for generating the swept frequency signal on the transmission line network, and a phase coasting unit, such as a third-order phase locked loop (PLL), connected downstream of the DDS to linearize the swept frequency signal. The phase calibrator comprises a frequency measurement unit to determine the frequency difference between the swept frequency signal and the reflected swept frequency signal, and to output the delay measurement signal. The frequency measurement unit may include a dual direction coupler at each of the plurality of taps to detect the swept frequency signal and the reflected swept frequency signal on the transmission line network, and a mixer for combining the swept frequency signal and the reflected swept frequency signal. A Discrete Fourier Transform (DFT) unit or a Fast Fourier Transform (FFT) unit downstream from the mixer may receive the combined signal from the mixer and output the delay measurement signal.

Other objects, features, and advantages in accordance with the present invention are provided by a method of calibrating phase in a phased array antenna including a transmission line network, having a plurality of taps, and connected to a plurality of antenna radiating elements, and a reference signal generator connected to the transmission line network to provide a reference frequency signal to each of the plurality of antenna radiating elements. The method includes generating a calibration signal, e.g. a swept frequency signal, on the transmission line network, the calibration signal being reflected at the reference signal generator to create a reflected calibration signal on the transmission line network. A frequency difference between the calibration signal and the reflected calibration signal is determined at each of the plurality of taps, and a delay measurement signal is output to the antenna radiating elements for adjusting a phase of the reference frequency signal.

The swept frequency signal is preferably generated on the transmission line network with a direct digital synthesizer (DDS) and linearized with a phase coasting unit, e.g. a third-order phase locked loop (PLL), connected downstream of the DDS. Determining the frequency difference between the swept frequency signal and the reflected swept frequency signal may include detecting the swept frequency signal and the reflected swept frequency signal on the transmission line network with a dual direction coupler at each of the plurality of taps, and combining the swept frequency signal and the reflected swept frequency signal to generate a combined signal before performing a Discrete Fourier Transform (DFT) or a Fast Fourier Transform (FFT) on the combined signal.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
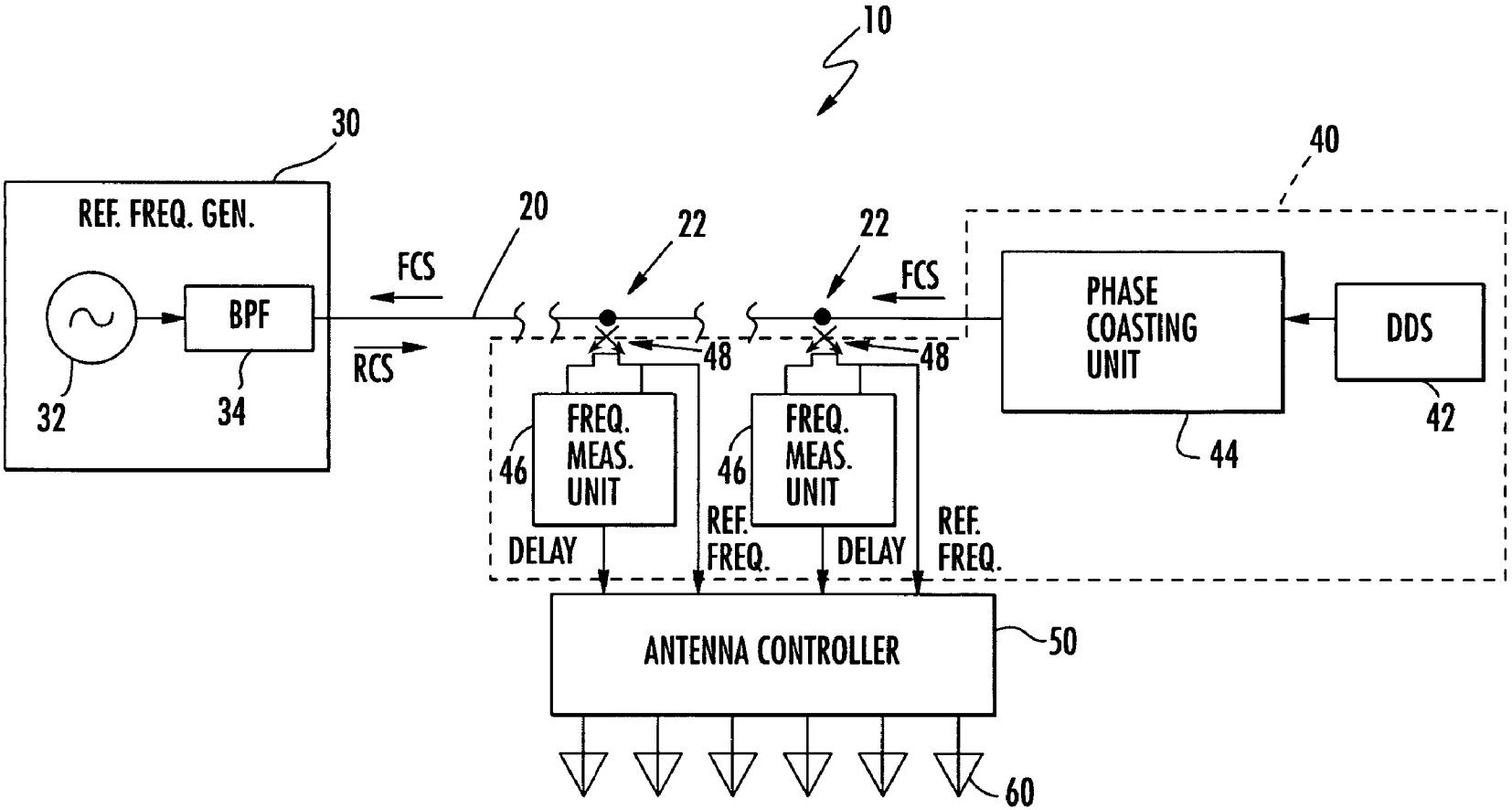
FIG. 1 is schematic diagram illustrating a phased array antenna including a phase calibrator in accordance with the present invention.
Figure 2:
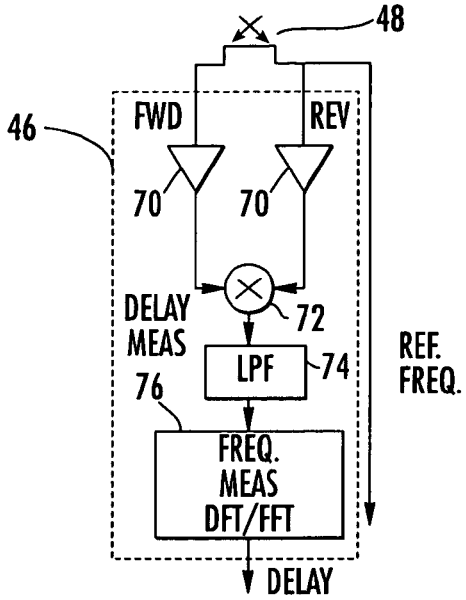
FIG. 2 is a schematic diagram of the frequency measurement unit of the phase calibrator of FIG. 1.

Referring initially to FIGS. 1 and 2, a phased array antenna 10 with distributed phase calibration will be described. The phased array antenna 10 includes a plurality of antenna radiating elements 60 connected to a transmission line network 20, e.g. optical or coaxial cable network. The transmission line network includes a plurality of taps 22. A reference signal generator 30 is connected to the transmission line network 20 to provide a reference frequency signal REF.FREQ to each of the plurality of antenna radiating elements 60. A centrally located reference is used to provide calibration over long transmission line lengths to taps 22. The phase of the received reference frequency signal REF-.FREQ is shifted due to various temperature gradients over the transmission line network 20. Such a reference signal generator 30 may include a signal source 32 and a filter 34 as would be appreciated by the skilled artisan.

A phase calibrator 40 generates a calibration signal FCS, e.g. a swept frequency signal or chirp, on the transmission line network 20. The swept frequency signal FCS is reflected at the reference signal generator 30 to create a reflected swept frequency signal RCS. The phase calibrator 40 determines a frequency difference between the swept frequency signal FCS and the reflected swept frequency signal RCS at each of the plurality of taps 22, and outputs a delay measurement signal DELAY to be used by the antenna radiating elements 60, e.g. via an antenna controller 50 or phase shifter, for adjusting a phase of the reference frequency signal.

The phase calibrator 40 preferably comprises a direct digital synthesizer (DDS) 42 for generating the swept frequency signal or chirp on the transmission line network 20. The DDS 42 provides a fine phase continuity but still includes discrete frequency steps. In other words, the DDS 42 is subject to measurement quantization due to the DDS clock rates and calibration must be done under similar conditions to that actually used. Accordingly, in a preferred embodiment, a phase coasting unit 44, such as a third-order phase locked loop (PLL), may be connected downstream of the DDS 42 to linearize the swept frequency signal. In other words, the phase coasting unit 44 will provide greater resolution by smoothing out the discrete frequency steps in the chirp from the DDS 42. The phase calibrator 40 includes frequency measurement units 46 to determine the frequency difference between the swept frequency signal FCS and the reflected swept frequency signal RCS, and to output the delay measurement signal DELAY. A dual direction coupler 48 at each of the plurality of taps 22 detects the swept frequency signal FCS and the reflected swept frequency signal RCS on the transmission line network 20.

Referring in particular to FIG. 2, the details of an embodiment of a frequency measurement unit 46 will be described. The frequency measurement unit 46 may include amplifiers 70 and a mixer 72 for combining the swept frequency signal FCS and the reflected swept frequency signal RCS. Also, a filter 74 and a Discrete Fourier Transform (DFT) unit or a Fast Fourier Transform (FFT) are provided downstream from the mixer 72 to receive the combined signal and output the delay measurement signal DELAY. The frequency measurement units 46 are spaced to provide a desired resolution at specific frequencies. Alternative transform units may include digital signal processing and/or include Wavelet Transform and Goertzel DFT since approximate delay and therefore frequency is known.

Figure 3:
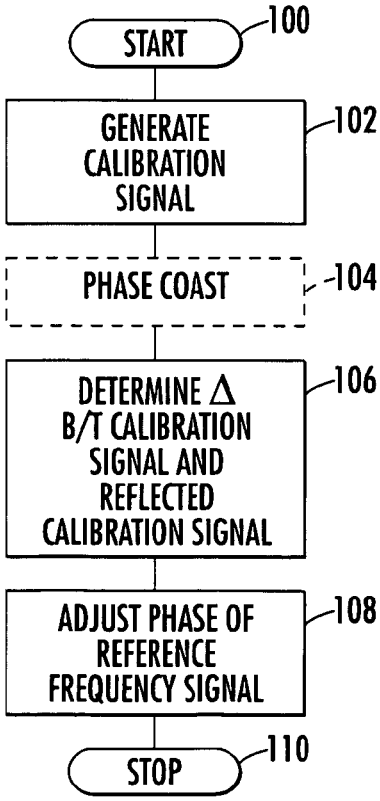
FIG. 3 is a flowchart illustrating the method of calibrating phase in a phased array antenna in accordance with the present invention.

A method aspect of the present invention will now be described with reference to the flowchart shown in FIG. 3. The method of calibrating phase may be used in a phased array antenna 10 including a transmission line network 20, having a plurality of taps 22, and connected to a plurality of antenna radiating elements 60, and a reference signal generator 30 connected to the transmission line network to provide a reference frequency signal to each of the plurality of antenna radiating elements, e.g. as discussed above. The method begins at block 100 and includes generating a calibration signal FCS, e.g. a swept frequency signal or chirp, on the transmission line network 20 (block 102). As discussed, the swept frequency signal FCS is reflected at the reference signal generator 30 to create a reflected swept frequency signal RCS on the transmission line network 20. At block 106, a frequency difference between the swept frequency signal FCS and the reflected swept frequency signal RCS is determined at each of the plurality of taps 22, and a phase of the reference frequency signal REF.FREQ is adjusted with the delay measurement signal DELAY.

The swept frequency signal FCS is preferably generated on the transmission line network 20 with a direct digital synthesizer (DDS) 42 and linearized (block 104) with a phase coasting unit 44, e.g. a third-order phase locked loop (PLL), connected downstream of the DDS. Determining the frequency difference between the swept frequency signal FCS and the reflected swept frequency signal RCS may include detecting the swept frequency signal and the reflected swept frequency signal on the transmission line network with a dual direction coupler 48 at each of the plurality of taps 22, and combining the swept frequency signal and the reflected swept frequency signal to generate a combined signal before performing a Discrete Fourier Transform (DFT) or a Fast Fourier Transform (FFT) on the combined signal.

The phase calibration approach of the present invention is relatively low cost and provides an accurate measurement of time delay over the transmission line network. The approach avoids inaccuracy caused by thermal gradients as it is not affected by sunlight obscuration and/or nonlinear delay temperature coefficients.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A phased array antenna comprising:

a plurality of antenna radiating elements;

a transmission line network connected to the plurality of antenna radiating elements and including a plurality of taps;

a reference signal generator connected to the transmission line network to provide a reference frequency signal to each of the plurality of antenna radiating elements; and a phase calibrator to generate a calibration signal on the transmission line network, the calibration signal being reflected at the reference signal generator to create a reflected calibration signal on the transmission line network, to determine a frequency difference between the calibration signal and the reflected calibration signal at each of the plurality of taps, and to output a delay measurement signal to the antenna radiating elements for adjusting a phase of the reference frequency signal.

2. A phased array antenna according to claim 1, wherein the phase calibrator comprises a direct digital synthesizer (DDS) for generating the calibration signal as a swept frequency signal on the transmission line network.

3. A phased array antenna according to claim 2, wherein the phase calibrator further comprises a phase coasting unit connected downstream of the DDS to linearize the swept frequency signal.

4. A phased array antenna according to claim 3, wherein the phase coasting unit comprises a third-order phase locked loop (PLL).

5. A phased array antenna according to claim 1, wherein the phase calibrator comprises a plurality of frequency measurement units each to determine the frequency difference between the calibration signal and the reflected calibration signal at a respective one of the plurality of taps, and to output the delay measurement signal.

6. A phased array antenna according to claim 5, wherein the frequency measurement unit comprises a dual direction coupler at each of the plurality of taps to detect the calibration signal and the reflected calibration signal on the transmission line network.

7. A phased array antenna according to claim 6, wherein the frequency measurement unit further comprises a mixer for combining the calibration signal and the reflected calibration signal.

8. A phased array antenna according to claim 7, wherein the frequency measurement unit further comprises a Discrete Fourier Transform (DFT) unit downstream from the mixer and outputting the delay measurement signal.

9. A phased array antenna according to claim 7, wherein the frequency measurement unit further comprises a Fast Fourier Transform (FFT) unit downstream from the mixer and outputting the delay measurement signal.

10. A phased array antenna according to claim 1, wherein the transmission line network comprises an optical transmission line network.

11. A phased array antenna according to claim 1, wherein the transmission line network comprises a coaxial cable transmission line network.

12. A phased array antenna according to claim 1, further comprising an antenna controller to receive the delay signal and the reference frequency signal, and to adjust the phase of the reference frequency signal based upon the delay measurement signal.

13. A phased array antenna comprising:

a plurality of antenna radiating elements;

a transmission line network connected to the plurality of antenna radiating elements and including a plurality of taps;

a reference signal generator connected to the transmission line network to provide a reference frequency signal to each of the plurality of antenna radiating elements; and a phase calibrator comprising a direct digital synthesizer (DDS) for generating a swept frequency signal on the transmission line network, the swept frequency signal being reflected at the reference signal generator to create a reflected swept frequency signal on the transmission line network, a phase coasting unit connected downstream of the DDS to linearize the swept frequency signal, and a plurality of frequency measurement units each including a dual direction coupler at a respective one of the plurality of taps to detect the swept frequency signal and the reflected swept frequency signal, and associated circuitry to determine a frequency difference between the swept frequency signal and the reflected swept frequency signal and to output a delay measurement signal to the antenna radiating elements for adjusting a phase of the reference frequency signal.

14. A phased array antenna according to claim 13, wherein the transmission line network comprises an optical transmission line network.

15. A phased array antenna according to claim 13, wherein the transmission line network comprises a coaxial cable transmission line network.

16. A phased array antenna according to claim 13, wherein the phase coasting unit comprises a third-order phase locked loop (PLL).

17. A phased array antenna according to claim 13, wherein the associated circuitry of the frequency measurement unit comprises a mixer for combining the swept frequency signal and the reflected swept frequency signal.

18. A phased array antenna according to claim 17, wherein the associated circuitry of the frequency measurement unit further comprises a Discrete Fourier Transform (DFT) unit downstream from the mixer and outputting the delay measurement signal.

19. A phased array antenna according to claim 17, wherein the associated circuitry of the frequency measurement unit further comprises a Fast Fourier Transform (FFT) unit downstream from the mixer and outputting the delay measurement signal.

20. A phased array antenna according to claim 13, further comprising an antenna controller to receive the delay measurement signal and the reference frequency signal, and to adjust the phase of the reference frequency signal.

21. A method of calibrating phase in a phased array antenna including a transmission line network, having a plurality of taps, and connected to a plurality of antenna radiating elements, and a reference signal generator connected to the transmission line network to provide a reference frequency signal to each of the plurality of antenna radiating elements, the method comprising:

generating a calibration signal on the transmission line network, the calibration signal being reflected at the reference signal generator to create a reflected calibration signal on the transmission line network;

determining a frequency difference between the calibration signal and the reflected calibration signal at each of the plurality of taps; and outputting a delay measurement signal to the antenna radiating elements for adjusting a phase of the reference frequency signal.

22. A method according to claim 21, wherein the calibration signal comprises a swept frequency signal generated on the transmission line network with a direct digital synthesizer (DDS).

23. A method according to claim 22, further comprising linearizing the swept frequency signal with a phase coasting unit connected downstream of the DDS.

24. A method according to claim 23, wherein the phase coasting unit comprises a third-order phase locked loop (PLL).

25. A method according to claim 21, wherein determining the frequency difference between the swept frequency signal and the reflected swept frequency signal includes detecting the swept frequency signal and the reflected swept frequency signal on the transmission line network with a dual direction coupler at each of the plurality of taps.

26. A method according to claim 25, wherein determining the frequency difference between the swept frequency signal and the reflected swept frequency signal further includes combining the swept frequency signal and the reflected swept frequency signal to generate a combined signal.

27. A method according to claim 26, wherein determining the frequency difference between the swept frequency signal and the reflected swept frequency signal further includes performing a Discrete Fourier Transform (DFT) on the combined signal.

28. A method according to claim 26, wherein determining the frequency difference between the swept frequency signal and the reflected swept frequency signal further includes performing a Fast Fourier Transform (FFT) on the combined signal.

29. A method according to claim 21, wherein the transmission line network comprises an optical transmission line network.

30. A method according to claim 21, wherein the transmission line network comprises a coaxial cable transmission line network.

* * * * *